US005170645A

United States Patent [19]

Lonati et al.

[11] Patent Number: 5,170,645

[45] Date of Patent: Dec. 15, 1992

[54] DIRECT DRIVE CIRCULAR KNITTING MACHINE

[75] Inventors: Francesco Lonati; Ettore Lonati; Fausto Lonati; Tiberio Lonati, all of Brescia, Italy

[73] Assignee: S.F.I.M. S.r.l., Brescia, Italy

[21] Appl. No.: 790,060

[22] Filed: Nov. 12, 1991

[51] Int. Cl.[5] ..... D04B 9/00; D04B 15/94; H02K 1/22

[52] U.S. Cl. ..... 66/8; 310/75 R; 310/268

[58] Field of Search ..... 310/75 R, 368, 658, 310/156, 162; 318/254, 661; 66/1 R, 8, 56; 57/58.49, 58.65

[56] References Cited

U.S. PATENT DOCUMENTS 4,283,664 8/1981 Ebert ..... 318/254 X
4,295,085 10/1981 Lafuze ..... 318/254 X
4,334,405 6/1982 von Colson ..... 57/58.49 X
4,629,920 12/1986 Hermann ..... 310/268 X
4,651,067 3/1987 Ito et al. ..... 318/254
4,794,293 12/1988 Fujisaki et al. ..... 310/268
4,943,748 7/1990 Shiozawa ..... 310/268 X
4,972,186 11/1990 Morris ..... 318/661 X

*Primary Examiner*—Werner H. Schroeder
*Assistant Examiner*—John J. Calvert
*Attorney, Agent, or Firm*—Guido Modiano; Albert Josif

[57] ABSTRACT

The direct drive circular knitting machine has a main structure rotatably supporting a needle cylinder having a needle cylinder axis. An electric motor is provided for rotating the needle cylinder with respect to the main structure about the needle cylinder axis. The electric motor has a rotor rigidly and coaxially connected to the needle cylinder, and a stator located adjacent to the rotor and supported by the main structure.

12 Claims, 5 Drawing Sheets 1
23
16a
10
2
3
13a
12a
9
11
5
10

DIRECT DRIVE CIRCULAR KNITTING MACHINE

BACKGROUND OF THE INVENTION

The present invention relates to a circular knitting machine for manufacturing socks, stockings and the like.

As known, in circular knitting machines for manufacturing socks, stockings and the like, the needle cylinder is actuated so as to rotate about its own axis by means of an electric motor which is accommodated in the base of the machine and is connected to the needle cylinder by means of a transmission which is generally of the gear type.

The angular position of the needle cylinder is furthermore controlled, generally by means of a position sensor, by an electric control element which actuates the various elements of the machine according to a program.

Control of the angular position of the needle cylinder and the precision required in the actuation of various devices mounted on these machines, entail minimum play among the various gears of the transmission, complicating the manufacture and assembly of said transmission.

Also due to this fact, it is necessary to provide an abundant lubrication of the gear train in order to dissipate the heat developed by the transmission during operation of the machine.

The gear transmission also creates noise and is a source of vibrations which can interfere with the system for controlling the angular position of the needle cylinder, causing inaccuracy of the information which is transmitted by the sensor to the electronic control components of the machine.

SUMMARY OF THE INVENTION

The aim of the present invention is to eliminate the above described disadvantages by providing a circular knitting machine for manufacturing socks, stockings and the like, which has an extremely simplified needle cylinder actuation with respect to conventional machines.

Within this aim, an object of the present invention is to provide a circular knitting machine which considerably contains the rotating masses, thereby achieving better dynamics and precision with respect to conventional machines, of the same category.

Another object of the present invention is to provide a circular knitting machine which has lower operating costs than known machines.

The above described aim, the objects mentioned and others which will become apparent hereinafter ar ®achieved by a circular knitting machine for manufacturing socks, stockings and the like according to the invention, which comprises a main structure which supports a needle cylinder which is rotatable about its own axis with respect to said main structure, an electric motor being provided for the rotary actuation of the needle cylinder about said axis, characterized in that said electric motor comprises a rotor which is rigidly and coaxially associated with said needle cylinder and a stator which is adjacent to said rotor and is supported by said main structure.

BRIEF DESCRIPTION OF THE DRAWINGS

Further characteristics and advantages of the invention will become apparent from the description of some preferred but not exclusive embodiments of a circular knitting machine for manufacturing socks, stockings and the like according to the invention, illustrated only by way of non-limitative example in the accompanying drawings, wherein.

DESCRIPTION OF THE PREFERRED EMBODIMENTS

Figure 1:
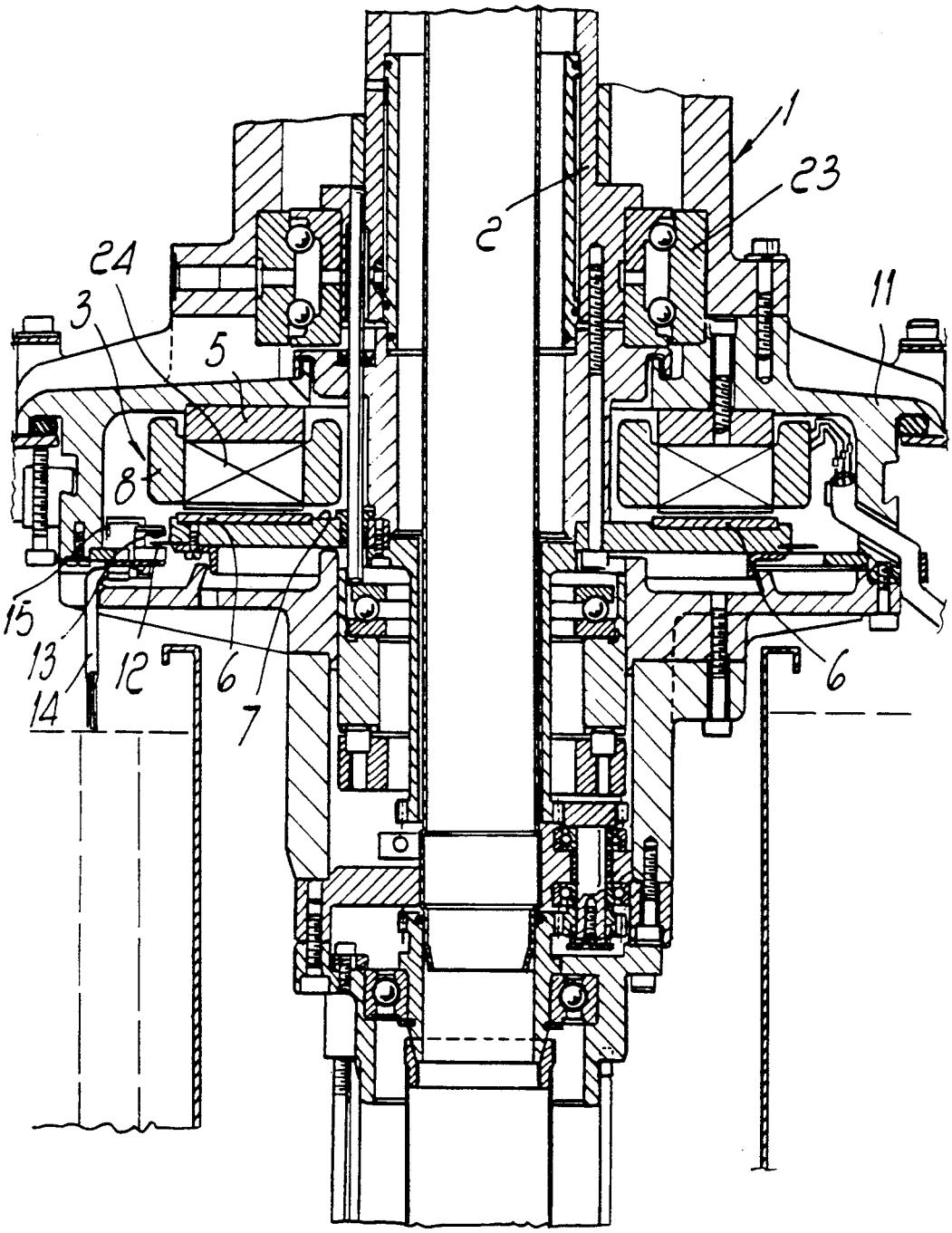
FIG. 1 is a sectional view of a portion of the machine according to a first embodiment of the invention, taken along a plane which passes through the axis of the needle cylinder.
Figure 2:
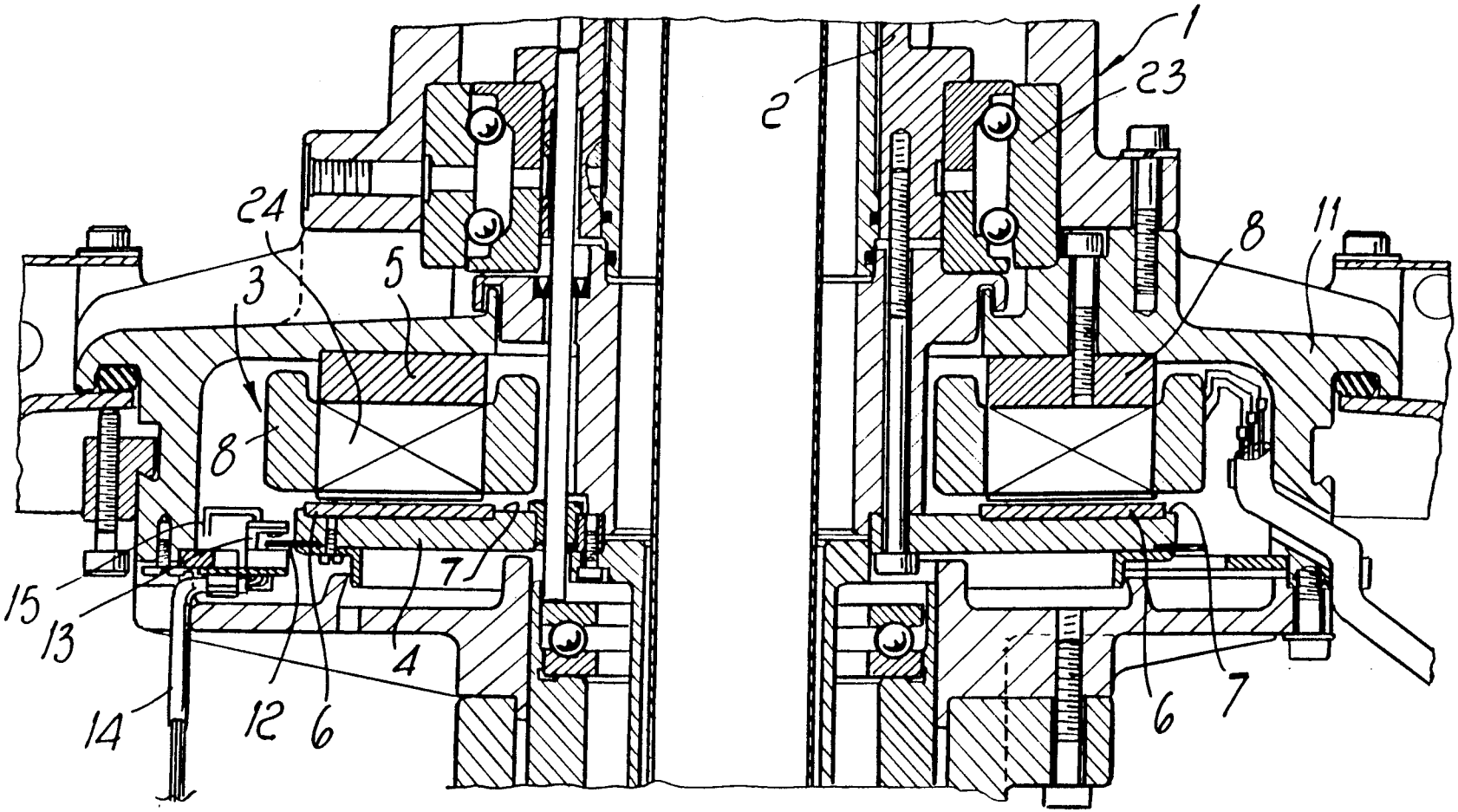
FIG. 2 is an enlarged view of a detail of FIG. 1.

With reference to FIGS. 1 and 2, a circular knitting machine for manufacturing socks, stockings and the like comprises a main structure, identified by the reference numeral 1, which supports a needle cylinder 2 which can rotate about its own axis with respect to the main structure 1. An electric motor, indicated by the reference numeral 3, is provided for the rotary actuation of the needle cylinder 2 about said axis. Said electric motor 3 comprises a rotor 4 which is rigidly and coaxially associated with the needle cylinder 2 and a stator 5 which is adjacent to the rotor 4 and is supported by the main structure 1.

The electric motor 3 is of the multiple-phase synchronous alternating-current type with electronic phase switching. It is well-known that it is usually complicated to vary its rotation rate, whereas there are considerable advantages with respect to direct-current motors or to asynchronous multiple-phase motors. The variation system which has been used is described hereinafter.

The electric motor 3 has, in a first embodiment, a disk-shaped rotor 4 which supports a plurality of permanent magnets 6 on a side 7 of the disk which faces the windings 8 which are supported by the stator 5. The disk furthermore supports means for detecting the position of said rotor 4. Further embodiments of the machine according to the invention arise depending on the type of position detection means employed.

In a first solution, FIGS. 1 and 2, the position detection means comprise an optical encoder which is arranged so that it has a stroboscopic ring 12 on the periphery of the disk and an optical sensor 13 supported by a bell housing or bell 11. The sensor 13 is electrically connected to an electronic driver of the motor by means of an electric cable 14 which exits from the bell 11 and is powered by electric cables 15 which enter said bell 11.

Figure 4:
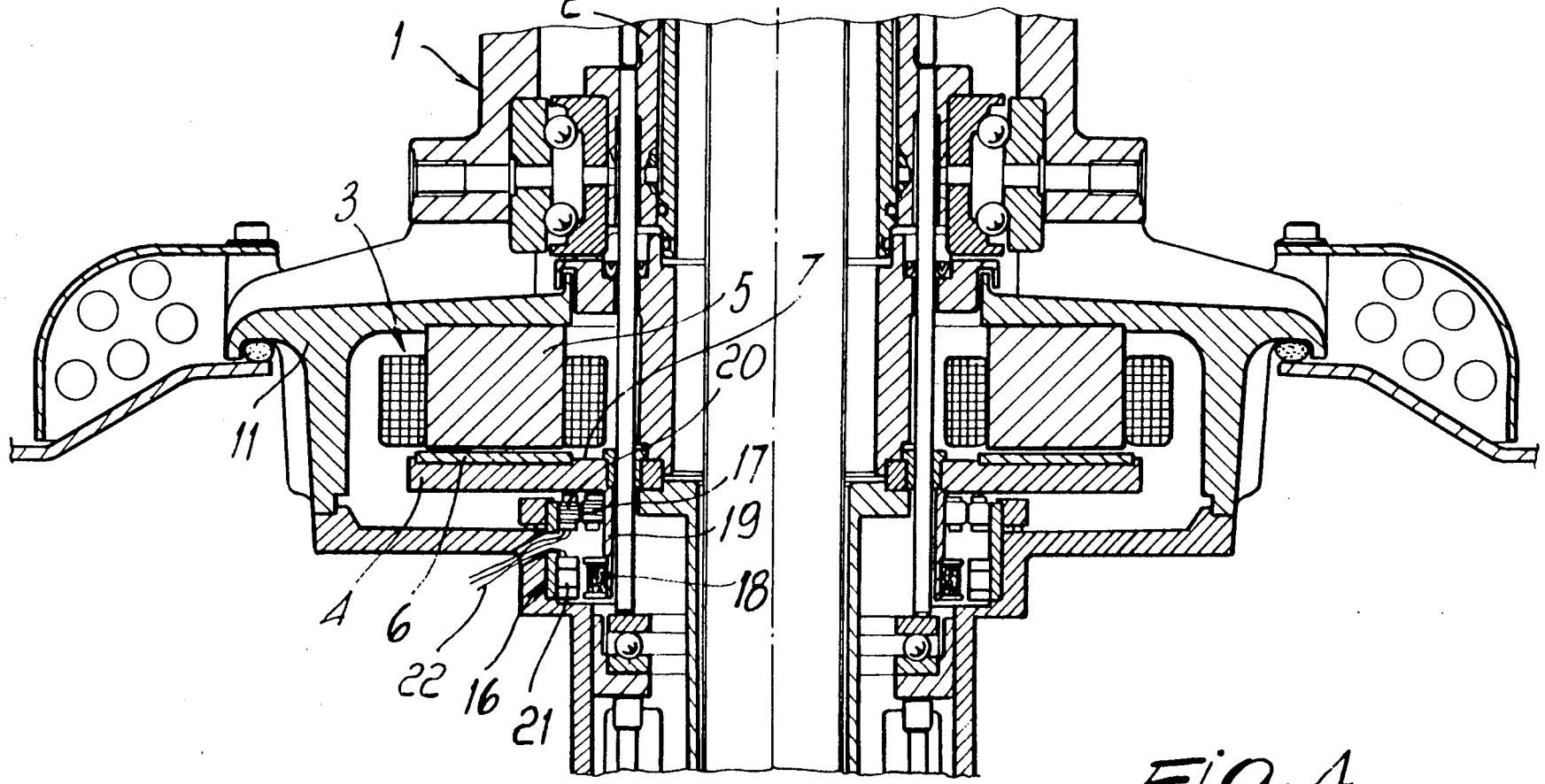
FIG. 4 is a sectional view of the machine in a third embodiment, taken similarly to FIG. 2.

In a second solution, FIG. 4, the disk is flanged and the position detection means comprise a resolver, identified by the reference numeral 16, which has rotor windings 17 and 18 fixed to a distal portion 19 of the flanged disk and stator windings 20 and 21 fixed to the bell 11. The resolver 16 is connected to the electronic driver of the motor by means of electric cables 22 which exit from the bell 11.

In a third solution, instead of the resolver 16 there is a magnetic detector which is arranged so that it has a ring of magnetic or ferromagnetic material on the distal portion 19 of the flanged disk and a magnetic sensor supported by the bell 11.

All the position detection means, regardless of their description, are electrically connected to means for the electronic driving of said electric motor.

The electric motor 3 has, in a second embodiment thereof, a rotor 4 which comprises a plurality of permanent magnets 9 which are fixed on the surface of the needle cylinder 2, whereas the stator comprises a plurality of windings 10 which are fixed on a bell 11 of the main structure 1. The windings 10 are arranged around the rotor 4. The rotor furthermore supports means for detecting the position of said rotor 4.

Figure 3:
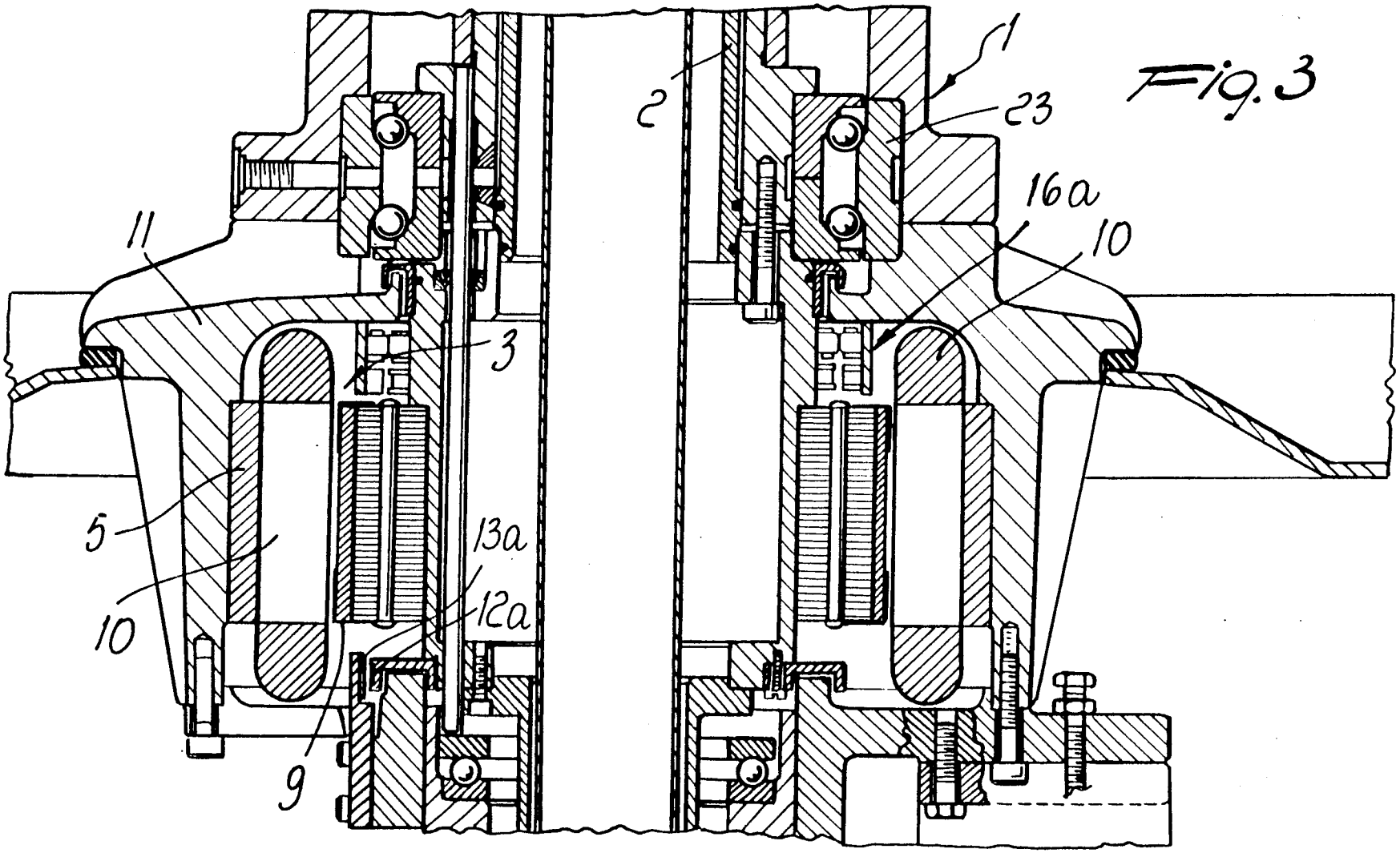
FIG. 3 is a sectional view of the machine in a second embodiment, taken similarly to FIG. 2.

The position detection means for this second embodiment comprise the same solutions described above for the disk-shaped motor, except that the rings of the optical 12*a* or magnetic detectors and the rotor windings of the resolver 16*a* are arranged on the needle cylinder 2, whereas the sensors 13*a* are in any case fixed to the bell 11, as more clearly illustrated in FIG. 3.

From the structural point of view, between the main structure 1 and the needle cylinder 2 there is a ball bearing 23 which supports the needle cylinder, withstanding a gravitational stress equal to the weight force of said needle cylinder 2. The execution of the circular knitting machine which uses a disk-shaped motor has a further advantage with respect to the known art. A magnetic attraction which opposes the weight force of the needle cylinder 2 is in fact exerted between the permanent magnets 6 and the gaps 24 of the windings even when the machine is at rest. When the machine is operating, this effect is augmented, and the magnetic attraction is further augmented, almost entirely canceling out the weight force which the needle cylinder applies to the bearing 23, reducing, and almost canceling out, the axial load applied to said bearing 23.

Figure 5:
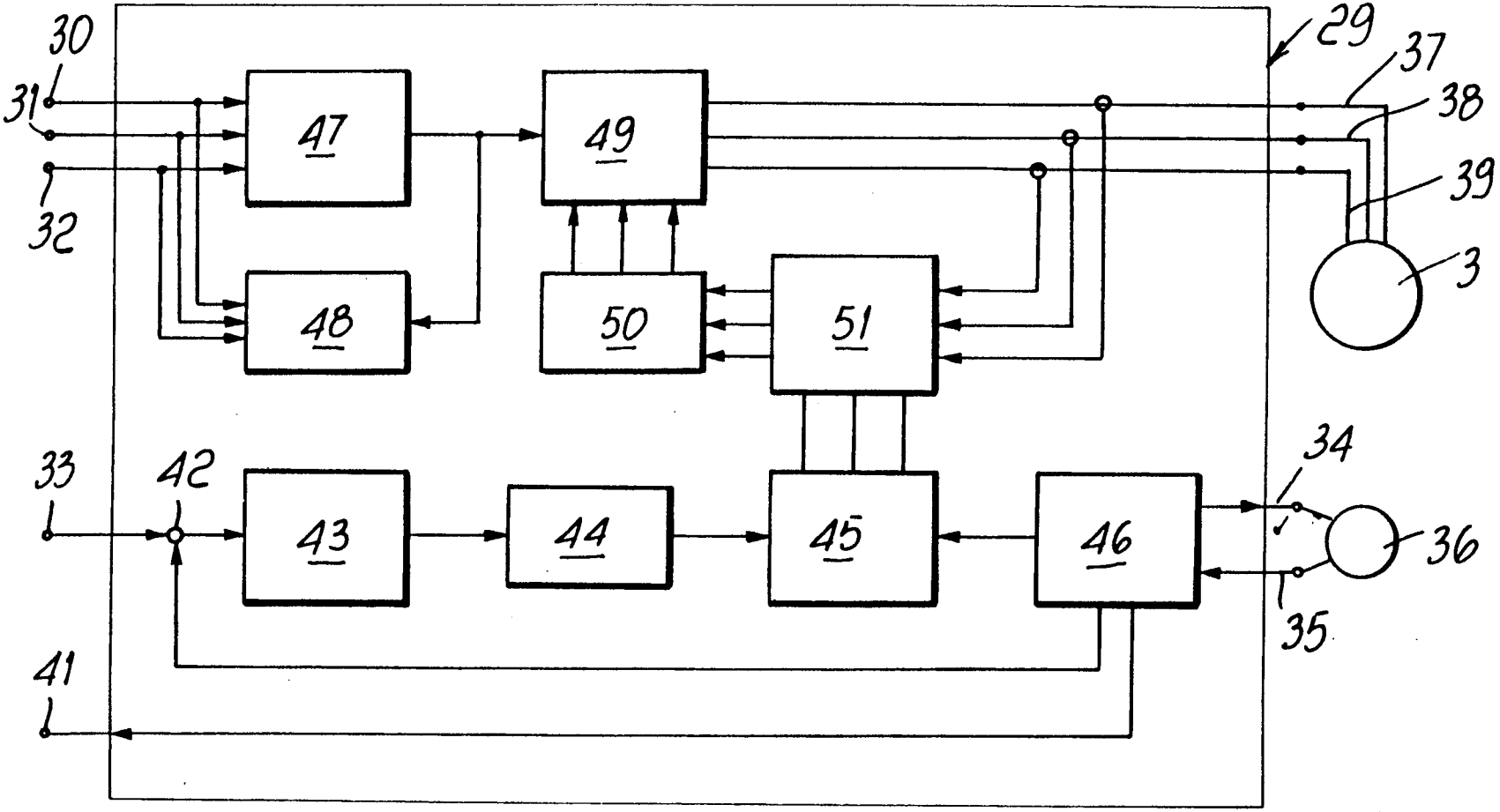
FIG. 5 is a block diagram of the structure of an electronic driver for the electric motor of the machine according to the invention.

The electronic driver means, generally indicated by the reference numeral 29 in FIG. 5, receive in input the power supply phases 30, 31 and 32 which arrive from the electric mains and a velocity control 33 which arrives from electronic control means of the circular knitting machine. The driver means 29 are electrically connected to the position detection means, here indicated by the reference numeral 36, by means of cables 34 and 35, and supply power to the electric motor 3 by means of the phases 37, 38 and 39. The driver means 29 vary the angular velocity of the synchronous motor and provide the electronic control means with the current position of the electric motor 3 by means of a terminal 41.

The signal applied to the velocity control 33 varies between −10 volts and +10 volts. The presence cf a negative sign and of a positive sign indicates that there are a preferential (positive) direction of rotation and an opposite (negative) direction of rotation. This is due to the particular application, which requires different velocities and different directions of rotation in order to manufacture a sock or stocking according to the preset program.

The signal in output from the terminal 41 is used by the electronic control means of the circular knitting machine to control the other parts of the machine, such as sliding needles, cams, and others, according to the angular position of the needle cylinder.

The electronic driver means 29 substantially comprise two control and power supply loops; the first one, termed current loop, supplies power to the electric motor 3; the second one, termed velocity loop, controls the velocity of the electric motor 3 by affecting the current loop.

The velocity loop comprises the velocity control terminal 33, downstream of which there is a subtractor 42 wherein the current velocity value arriving from a position sensor interface 46 is subtracted, with its sign, from the value of the velocity control in input to the electronic driver means 29, as explained hereinafter. The signal produced by the subtractor can be considered as a velocity error signal, equal to the difference between the required velocity value and the measured value of the rotation velocity. The output of the subtractor 42 constitutes the input for a PID (proportional integral derivative) controller of the velocity loop 43, which drives a current limiter 44. The signal in output from the current limiter 44 constitutes the input for a sine function generator 45, which also receives as input the position of the electric motor from the position sensor interface 46.

The sine function generator 45 emits three signals in output toward a PID controller of the current loop 51, as explained hereinafter. The last element of the velocity loop is the already mentioned position sensor interface 46, which supplies and receives the signals arriving from the sensor 36, regardless of its type, by means of the cables 34 and 35.

The position sensor interface 46 emits three signals: a signal representing the position of the motor, which is emitted by the electronic driver means 29 toward the electronic control elements of the circular knitting machine; a signal representing the angular velocity, which is input, with its sign, to the subtractor 42; and a signal representing the angular position, which is input to the sine function generator 45.

In practice, the velocity loop is intended to generate, by means of the sine function generator 45, three sinusoidal functions of a particular frequency which are always mutually offset by 120°, the frequency of which is a function of the signal sent by means of the velocity control 33, decreased or increased by the angular velocity which arrives from the position sensor interface 46, conveniently processed by the cascade constituted by the PID controller of the velocity loop 43 and by the current limiter 44, and is a function of the current velocity of the motor, detected by the position sensor interface 46.

In this manner there is a first degree of freedom in the control of the electric motor, which is given by the frequency of the power supply phases, which control, as known, the angular velocity of the rotating magnetic field in the motor 3, i.e. the velocity, minus the losses in the gaps and in the windings and other mechanical losses, of the rotor of the motor 3.

The current loop comprises a power supply 47 and a braking unit 48, which receive in parallel the three phases of the mains 30, 31, and 32. The power supply 47 emits a signal, obtained from the three phases, toward a transistor bridge 49 which has, as inputs, also three sinusoidal signals arriving from a pulse width modulator PWM 50, as better explained hereinafter. The transistor bridge 49 emits three signals in output which constitute the power supplies 37, 38 and 39 for the motor 3.

The signal in output from the power supply 47 furthermore constitutes the input for the braking unit 48, which when requested electromagnetically brakes the needle cylinder 2 when enabling for the rotation of the needle cylinder, i.e. of the rotor of the motor 3, ceases.

A PID controller of the current loop 51 receives in input the three signals which are proportional to the three currents sent to the motor in output from the transistor bridge 49 and the three signals arriving from the sine function generator 45. Said sine function generator 45 outputs three signals, which have a frequency equal to the frequency required by the velocity control, or rather produce a velocity adjustment which is directly linked to the velocity control of the electronic control element of the circular knitting machine. The signals in input, after being processed by the PID controller of the current loop 51, produce three output signals which are input to a pulse width modulator PWM 50, which produces the second degree of freedom of the electronic actuation means 29, since it allows to modulate the width of the signal or rather of the three phases of the current, thus selecting the mechanical torque of the rotor of the motor 3, i.e. of the needle cylinder 2.

The pulse width modulator PWM 50 emits three output signals, which have the frequency selected by means of the PID controller of the current loop 51 and the width modulated by the pulse width modulator PWM 50. The signals thus emitted are sent into the transistor bridge 49, inside which the three phases of the power supply are provided by combining the signals which arrive from the pulse width modulator PWM 50 and the signal arriving from the power supply 47.

For the protection of the electronic driver means 29 there is an electric circuit (not illustrated) which protects the driver 29 and the electric motor against short circuits, voltage surges, current surges, overheating and others.

The motor employed, which is a brushless one, or rather one without sliding contacts such as brushes, carbon contacts or others between the power supply and the rotor, inverting the conventional structure of the motor, is a multiple-phase synchronous alternating-current electric motor, and in particular it is a disk-shaped motor in one of the preferred embodiments; said motor allows to obtain considerable advantages from the point of view of use and maintenance, since it in fact requires very little maintenance and has, from a mechanical point of view, a reduced space occupation and high dynamic performance, with the simultaneous advantage of having a substantially constant mechanical torque at all possible rotation rates.

It has been observed that the circular knitting machine according to the invention achieves the intended aim and objects, since it reduces mechanical complexity by eliminating the gear transmission and, by placing the rotor of the synchronous electric motor directly on the needle cylinder, it on one hand decreases the manufacturing costs of the machine and on the other hand increases the possibility of control of said needle cylinder.

The invention thus conceived is susceptible to numerous modifications and variations, all of which are within the scope of the inventive concept. The motor 3 can be replaced with direct-current electric motors or with asynchronous electric motors, without obtaining all of the above described advantages, and most of all with an increase in the space occupation of the machine at least equal to one order of magnitude with respect to the synchronous electric motor. All the details may furthermore be replaced with other technically equivalent elements.

In practice, the materials employed, as well as the dimensions, may be any according to the requirements.

We claim:

1. Circular knitting machine for manufacturing socks, stockings and the like, comprising a main structure which supports a needle cylinder rotatable about an axis with respect to said main structure, an electric motor being provided for the rotary actuation of the needle cylinder about said axis, wherein said electric motor comprises a rotor rigidly and coaxially associated with said needle cylinder and a stator adjacent to said rotor and supported by said main structure.

2. Circular knitting machine according to claim 1, wherein said electric motor is of the multiple-phase synchronous alternating-current type with electronic phase switching.

3. Circular knitting machine according to claim 1, wherein said electric motor is of the multiple-phase synchronous alternating-current type with electronic phase switching and wherein said stator supports means for detecting the position of said rotor.

4. Circular knitting machine according to claim 3, wherein said position detection means comprises an optical encoder arranged so that said detection means has a stroboscopic ring on said rotor and an optical sensor supported by said stator.

5. Circular knitting machine according to claim 3, wherein said position detection means comprises a magnetic detector arranged so that said detection means has a ring of magnetic or ferromagnetic material on said rotor and has a magnetic sensor supported by said stator.

6. Circular knitting machine according to claim 3, wherein said position detection means comprise a resolver the rotor windings whereof are fixed to said rotor and the stator windings whereof are fixed to said stator.

7. Circular knitting machine according to claim 2, wherein said electric motor has a disk-shaped rotor for supporting a plurality of permanent magnets on a side thereof facing the windings supported by said stator.

8. Circular knitting machine according to claim 2, wherein said rotor comprises a plurality of permanent magnets fixed on the surface of said needle cylinder, whereas said stator comprises a plurality of windings fixed on a bell of said main structure and are arranged around said rotor.

9. Circular knitting machine according to claim 3, wherein electronic driver means receives in input the power supply phases arriving from an electric mains and a velocity variation control arriving from electronic control means of said circular knitting machine, said driver means being electrically connected to said position detection means and supplying said electric motor, said electronic driver means being suitable for varying the velocity of the synchronous motor and for supplying said electronic control means with the current position of said electric motor.

10. Circular knitting machine according to claim 1, wherein said electric motor has a disk-shaped rotor for supporting a plurality of permanent magnets on a side thereof facing the windings supported by said stator and wherein a magnetic attraction arises between the permanent magnets of said disk and the gaps of said windings and, when the motor rotates, opposes the weight force acting on the needle cylinder, said magnetic attraction being suitable for substantially reducing the gravitational force, at least partially relieving the load acting on a bearing arranged between said needle cylinder and said main structure.

11. Circular knitting machine according to claim 1, wherein said electric motor is a direct-current motor.

12. Circular knitting machine according to claim 1, wherein said electric motor is an asynchronous multiple-phase motor.

* * * * *